US011508192B2

(12) United States Patent
Bou Daher et al.

(10) Patent No.: US 11,508,192 B2
(45) Date of Patent: Nov. 22, 2022

(54) SYSTEMS AND METHODS FOR DETECTING NOISE FLOOR OF A SENSOR

(71) Applicant: Bose Corporation, Framingham, MA (US)

(72) Inventors: Elie Bou Daher, Marlborough, MA (US); Cristian M. Hera, Lancaster, MA (US)

(73) Assignee: Bose Corporation, Framingham, MA (US)

( * ) Notice: Subject to any disclaimer, the term of this patent is extended or adjusted under 35 U.S.C. 154(b) by 410 days.

(21) Appl. No.: 16/747,932

(22) Filed: Jan. 21, 2020

(65) Prior Publication Data

US 2021/0225097 A1 Jul. 22, 2021

(51) Int. Cl.
*G07C 5/08* (2006.01)
*G10K 11/178* (2006.01)
(Continued)

(52) U.S. Cl.
CPC ..... *G07C 5/0808* (2013.01); *G10K 11/17854* (2018.01); *G10L 25/18* (2013.01);
(Continued)

(58) Field of Classification Search
CPC . H04W 64/003; H04W 64/006; H04W 16/14; G10L 25/21; G10L 25/51; G10L 21/0364; G10L 25/18; G10L 2021/02165; G10L 21/0208; G10L 21/0232; G10L 25/06; G10L 25/78; G10L 19/0204; G10L 19/0212; G10L 2021/02168;
(Continued)

(56) References Cited

U.S. PATENT DOCUMENTS 10,403,263 B1 9/2019 Jain
11,180,185 B2 * 11/2021 Choi ..... B62D 5/0481
(Continued)

OTHER PUBLICATIONS

EadyMJetal:"AutomaticNoiseFloorSpectrumEstimationinthePresenceofSignals",Signals,Systems&Computers,1997. ConferenceRecordoftheThirty-FirstAsilomarConferenceonPacificRove,CA,USANov. 2-5, 1997,LosAlamitos,CA,USA,IEEEComput.Soc,US,Nov. 2, 1997(Nov. 2, 1997),pp. 877-881vol.1,XP032140634,DOI:10.1109/ACSSC.1997.680569.*

(Continued)

*Primary Examiner* — Lun-See Lao
(74) *Attorney, Agent, or Firm* — Bond, Schoeneck & King, PLLC

(57) ABSTRACT

A computer-implemented method for determining whether the noise floor of a sensor is deviated from an expected value, comprising the steps of: receiving a sensor signal from a sensor; determining a plurality of power spectral densities from a plurality of successive frames of samples of the sensor signal, each of the plurality of power spectral densities being determined from a respective frame of the plurality of successive frames, each power spectral density being comprised of a plurality of frequency bins, each frequency bin being associated with a power of the respective frame at the frequency of the respective frequency bin, wherein each successive frame of the plurality of successive frames differs by at least one sample; identifying a minimum power of the plurality of power spectral densities; and determining whether the minimum power exceeds a threshold value.

27 Claims, 12 Drawing Sheets

(51) Int. Cl.
*G10L 25/18* (2013.01)
*G10L 25/21* (2013.01)
*G10L 25/51* (2013.01)

(52) U.S. Cl.
CPC ..... *G10L 25/21* (2013.01); *G10L 25/51* (2013.01); *G10K 2210/3028* (2013.01)

(58) Field of Classification Search
CPC ..... G10L 21/0264; G10L 25/93; G10K 11/17854; G10K 2210/3028; G10K 11/17835; H04R 2400/01; H04R 2430/03; H04R 2460/05; H04R 25/00; H04R 25/70; H04R 29/00; H04R 3/005; H04R 1/083; H04R 1/1083; H04R 1/46; H04R 19/016; H04R 2410/07; H04R 2499/13; H04R 25/356; H04R 31/00; H04K 3/22; H04K 3/45; H04K 3/822; H04L 27/2647; H04L 5/0007; H04N 5/2354
USPC ..... 381/86, 94.1–94.5; 701/33; 700/94
See application file for complete search history.

(56) References Cited

U.S. PATENT DOCUMENTS

2019/0198005 A1* 6/2019 Cheung ..... G10L 21/0216
2019/0210459 A1* 7/2019 Kojima ..... B60K 28/12
2019/0341020 A1* 11/2019 Cheung ..... G10K 11/17883

OTHER PUBLICATIONS

International Search Report and the Written Opinion of the International Searching Authority, International Patent Application No. PCT/US2021/013662, pp. 1-11, dated May 6, 2021.
Ready M J et al: "Automatic noise floor spectrum estimation in the presence of signals", Signals, Systems & Computers, 1997. Conference Record of the Thirty-First Asilomar Conference on Pacific Grove, CA, USA Nov. 2-5, 1997, Los Alamitos, CA, USA, IEEE Comput. Soc, US, Nov. 2, 1997 (Nov. 2, 1997), pp. 877-881 vol. 1, XP032140634, DOI: 10.1109/ACSSC.1997.680569, ISBN: 978-0-8186-8316-9.
International Preliminary Report on Patentability, International Application No. PCT/US2021/013662, pp. 1-8, dated Aug. 4, 2022.

* cited by examiner

SYSTEMS AND METHODS FOR DETECTING NOISE FLOOR OF A SENSOR

BACKGROUND

This disclosure is generally directed to systems and methods for estimating the noise floor of a sensor and for detecting when the noise floor of a sensor deviates from an expected noise floor. In particular, various examples described in this disclosure are directed to systems and methods for estimating the noise floor of an accelerometer, deployed in a vehicle-implemented noise-cancellation system, and for detecting when the estimated noise floor deviates from an expected noise floor.

SUMMARY

All examples and features mentioned below can be combined in any technically possible way.

According to an aspect, a computer-implemented method for detecting a noise floor of a sensor, comprises the steps of: receiving a sensor signal from a sensor; determining a plurality of power spectral densities from a plurality of successive frames of samples of the sensor signal, each of the plurality of power spectral densities being determined from a respective frame of the plurality of successive frames, each power spectral density being comprised of a plurality of frequency bins, each frequency bin being associated with a power of the sensor signal at the frequency of the respective frequency bin, wherein each successive frame of the plurality of successive frames differs by at least one sample; identifying a minimum power of the plurality of power spectral densities; and determining whether the minimum power exceeds a threshold value.

In an example, the computer-implemented method further comprises the step of determining, according to at least one condition, whether a vehicle in which the sensor is disposed is in an idle state, wherein the step of determining whether the estimated noise floor of the sensor signal exceeds a threshold value only occurs when the vehicle is in the idle state.

In an example, the at least one condition is selected from at least one of: vehicle engine revolutions per minute, accelerator pedal position, vehicle speed, and engine harmonics.

In an example, the at least one condition further comprises detecting whether a door of the vehicle opened or closed.

In an example, the computer-implemented method further comprises the step of filtering each power spectral density of the plurality of power spectral densities such that frequency spikes within each power spectral density are reduced.

In an example, each power spectral density is filtered using median filtering.

In an example, the computer-implemented method further comprises the step of incrementing a counter by a first value if the estimated noise floor exceeds a threshold value and decrementing a counter by a second value if the estimated noise floor fails to exceed the threshold value.

In an example, the computer-implemented method further comprises the step of excluding the sensor signal from an adaptive filter update calculation if a value of the counter exceeds a counter value.

In an example, the first value and the second value are the same.

In an example, the computer-implemented method further comprises the steps of incrementing a counter by a predetermined amount if the estimated noise exceeds the threshold value; excluding the sensor signal from an adaptive filter update calculation if a value of the counter exceeds a counter value; and excluding a filter associated with the sensor signal from the production of a noise-cancellation signal.

According to another aspect, a non-transitory storage medium comprises program code that, when implemented by a processor, causes the processor to execute the steps comprising: receiving a sensor signal from a sensor; determining a plurality of power spectral densities from a plurality of successive frames of samples of the sensor signal, each of the plurality of power spectral densities being determined from a respective frame of the plurality of successive frames, each power spectral density being comprised of a plurality of frequency bins, each frequency bin being associated with a power of the sensor signal at the frequency of the respective frequency bin, wherein each successive frame of the plurality of successive frames differs by at least one sample; identifying a minimum power of the plurality of power spectral densities; and determining whether the minimum power exceeds a threshold value.

In an example, the program code further includes the step of determining, according to at least one condition, whether a vehicle in which the sensor is disposed is in an idle state, wherein the step of determining whether the estimated noise floor of the sensor signal exceeds a threshold value only occurs when the vehicle is in the idle state.

In an example, the at least one condition is selected from at least one of: vehicle engine revolutions per minute, accelerator pedal position, vehicle speed, and engine harmonics.

In an example, the at least one condition further comprises detecting whether a door of the vehicle opened or closed.

In an example, the program code further includes the step of filtering each power spectral density of the plurality of power spectral densities such that frequency spikes within each power spectral density are reduced.

In an example, each power spectral density is filtered using median filtering.

In an example, the program code further includes the step of incrementing a counter by a first value if the estimated noise floor exceeds a threshold value and decrementing a counter by a second value if the estimated noise floor fails to exceed the threshold value.

The details of one or more implementations are set forth in the accompanying drawings and the description below. Other features, objects, and advantages will be apparent from the description and the drawings, and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various aspects.

DETAILED DESCRIPTION

In a vehicle-implemented noise-cancellation system, accelerometers are often employed to generate reference signals for the noise-cancellation system. When an accelerometer malfunctions, the noise floor (that is, the noise present in the accelerometer output signal even when the accelerometer is not detecting any accelerations) tends to drift upward over time or sharply increase. The increased noise in the accelerometer signal can be interpreted by the noise-cancellation system as the reference signal itself, which, at best, degrades the performance of the noise-cancellation system and, at worst, causes the noise-cancellation system to generate noise in the vehicle cabin rather than cancel it.

It is thus desirable to identify a deviation in the expected noise floor of an accelerometer before the deviation affects the performance of the noise-cancellation system. It is also desirable to identify a deviation in the expected noise floor of an accelerometer during runtime, so that noisy accelerometer signals or malfunctioning accelerometers can be automatically excluded from the noise-cancellation system without intervention from the user or a technician. Further, it is desirable to identify a deviation in the expected noise floor of an accelerometer so that the malfunctioning accelerometer can be identified for servicing or replacement.

As described above, the systems and methods described in this disclosure for detecting a deviation in the expected floor of a sensor can be used, in various examples, by noise-cancellation systems such as those implemented in a vehicle. An example such of a vehicle-implemented noise-cancellation system will be briefly described, for purposes of illustration, in connection with FIGS. 1-2. However, in alternative examples, the systems and methods described herein can be used apart from a noise-cancellation system to identify any sensor with a noise floor that deviates from a norm.

Figure 1:
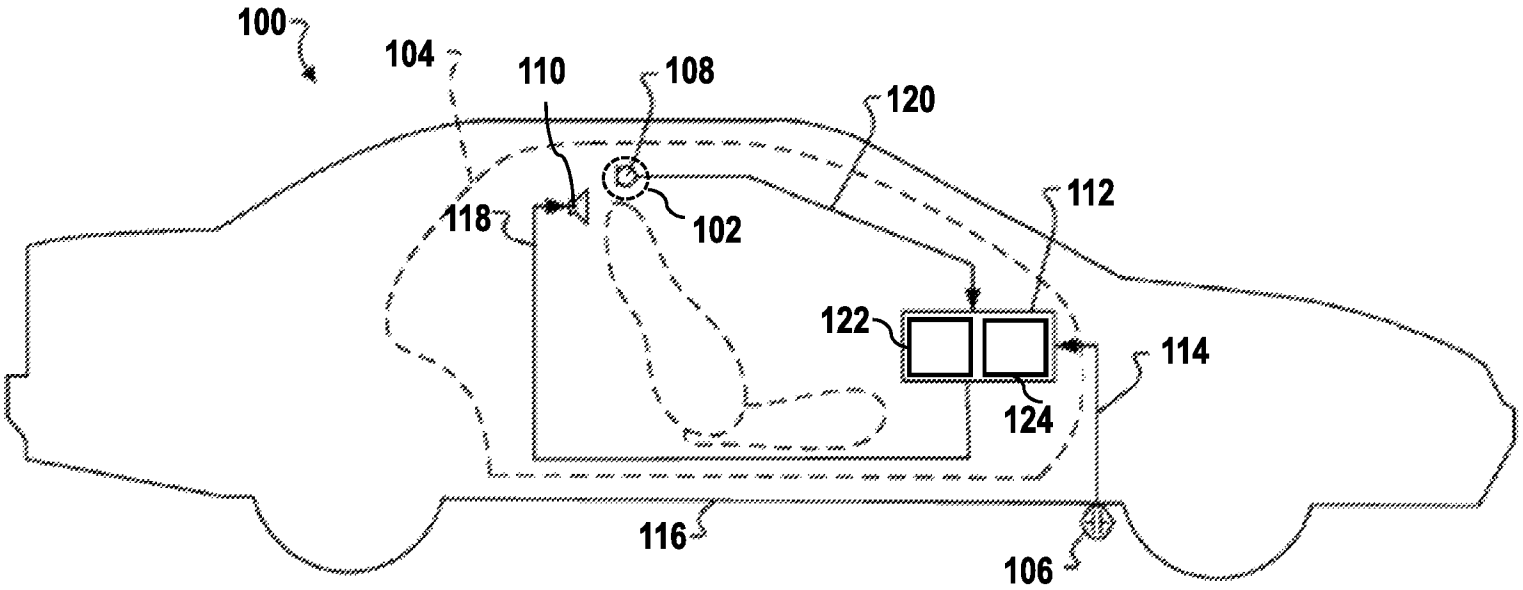
FIG. 1 depicts a schematic of a noise-cancellation system, according to an example.

FIG. 1 is a schematic view of an example noise-cancellation system 100. Noise-cancellation system 100 can be configured to destructively interfere with undesired sound in at least one cancellation zone 102 within a predefined volume 104 such as a vehicle cabin. At a high level, an example of noise-cancellation system 100 can include a reference sensor 106, an error sensor 108, an actuator 110, and a controller 112.

In an example, reference sensor 106 is configured to generate noise signal(s) 114 representative of the undesired sound, or a source of the undesired sound, within predefined volume 104. For example, as shown in FIG. 1, reference sensor 106 can be an accelerometer, or a plurality of accelerometers, mounted to and configured to detect vibrations transmitted through a vehicle structure 116. Vibrations transmitted through the vehicle structure 116 are transduced by the structure into undesired sound in the vehicle cabin (perceived as road noise), thus an accelerometer mounted to the structure provides a signal representative of the undesired sound Actuator 110 can, for example, be speakers distributed in discrete locations about the perimeter of the predefined volume. In an example, four or more speakers can be disposed within a vehicle cabin, each of the four speakers being located within a respective door of the vehicle and configured to project sound into the vehicle cabin. In alternate examples, speakers can be located within a headrest, or elsewhere in the vehicle cabin.

A noise-cancellation signal 118 can be generated by controller 112 and provided to one or more speakers in the predefined volume, which transduce the noise-cancellation signal 118 to acoustic energy (i.e., sound waves). The acoustic energy produced as a result of noise-cancellation signal 118 is approximately 180° out of phase with—and thus destructively interferes with—the undesired sound within the cancellation zone 102. The combination of sound waves generated from the noise-cancellation signal 118 and the undesired noise in the predefined volume results in cancellation of the undesired noise, as perceived by a listener in a cancellation zone.

Because noise-cancellation cannot be equal throughout the entire predefined volume, noise-cancellation system 100 is configured to create the greatest noise-cancellation within one or more predefined cancellation zones 102 with the predefined volume. The noise-cancellation within the cancellation zones can effect a reduction in undesired sound by approximately 3 dB or more (although in varying examples, different amounts of noise-cancellation can occur). Furthermore, the noise-cancellation can cancel sounds in a range of frequencies, such as frequencies less than approximately 350 Hz (although other ranges are possible).

Error sensor 108, disposed within the predefined volume, generates an error sensor signal 120 based on detection of residual noise resulting from the combination of the sound waves generated from the noise-cancellation signal 118 and the undesired sound in the cancellation zone. The error sensor signal 120 is provided to controller 112 as feedback, error sensor signal 120 representing residual noise uncanceled by the noise-cancellation signal. Error sensors 108 can be, for example, at least one microphone mounted within a vehicle cabin (e.g., in the roof, headrests, pillars, or elsewhere within the cabin).

It should be noted that the cancellation zone(s) can be positioned remotely from error sensor 108. In this case, the error sensor signal 120 can be filtered to represent an estimate of the residual noise in the cancellation zone(s). In either case, the error signal will be understood to represent residual undesired noise in the cancellation zone.

In an example, controller 112 can comprise a nontransitory storage medium 122 and processor 124. In an example, non-transitory storage medium 122 can store program code that, when executed by processor 124, implements the various filters and algorithms described below. Controller 112 can be implemented in hardware and/or software. For example, controller can be implemented by a SHARC floating-point DSP processor, but it should be understood that controller can be implemented by any other processor, FPGA, ASIC, or other suitable hardware.

Figure 2:
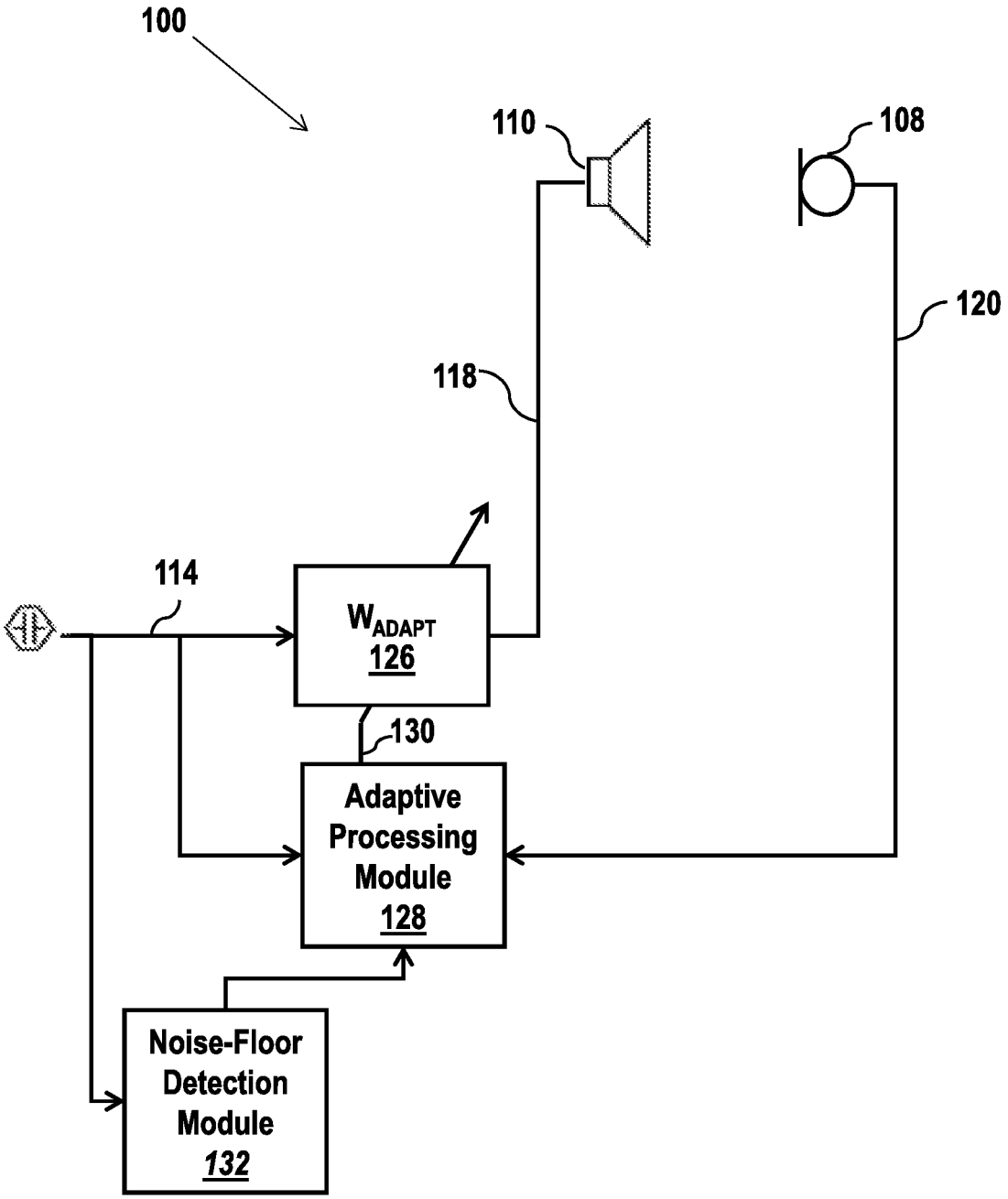
FIG. 2 depicts a block diagram of a noise-cancellation system, according to an example.

Turning to FIG. 2, there is shown a block diagram of an example of noise-cancellation system 100, including a plurality of filters implemented by controller 112. As shown, controller can define a control system including $W_{adapt}$ filter 126 and an adaptive processing module 128.

$W_{adapt}$ filter 126 is configured to receive the noise signal 114 of reference sensor 106 and to generate noise-cancellation signal 118. Noise-cancellation signal 118, as described above, is input to actuator 110 where it is transduced into the noise-cancellation audio signal that destructively interferes with the undesired sound in the predefined cancellation zone 102. $W_{adapt}$ filter 126 can be implemented as any suitable linear filter, such as a multi-input multi-output (MIMO) finite impulse response (FIR) filter. $W_{adapt}$ filter 126 employs a set of coefficients which define the noise-cancellation signal 118 and which can be adjusted to adapt to changing behavior of the vehicle response to road input (or to other inputs in non-vehicular noise-cancellation contexts).

The adjustments to the coefficients can be performed by an adaptive processing module 128, which receives as inputs the error sensor signal 120 and the noise signal 114 and, using those inputs, generates a filter update signal 130. The filter update signal 130 is an update to the filter coefficients implemented in $W_{adapt}$ filter 126. The noise-cancellation signal 118 produced by the updated $W_{adapt}$ filter 126 will minimize error sensor signal 120, and, consequently, the undesired noise in the cancellation zone.

The coefficients of $W_{adapt}$ filter 126 at time step n can be updated according to the following equation:

$$W_{adapt}[n+1] = W_{adapt}[n] + \mu(\hat{T}'_{de} * e)\frac{x}{\|x\|_2} \tag{1}$$

where $\hat{T}_{de}$ is an estimate of the physical transfer function between actuator 110 and the noise-cancellation zone 102, $\hat{T}'_{de}$ is the conjugate transpose of $\hat{T}_{de}$, e is the error signal, and x is the output signal of reference sensor 106. In the update equation, the output signal x of reference sensor is divided by the norm of x, represented as $\|x\|_2$.

In application, the total number of filters is generally equal to the number of reference sensors (M) multiplied by the number of speakers (N). Each reference sensor signal is filtered N times, and each speaker signal is then obtained as a summation of M signals (each sensor signal filtered by the corresponding filter).

Noise-cancellation system 100 further includes noise-floor detection module 132, which is configured to receive noise signal 114 in order to determine whether noise floor of the reference sensor 106 deviates from an expected amount. Noise-floor detection module 132 is an abstract representation of the computer-implemented method described in further detail below in and in connection with FIGS. 3A-3K. If the noise floor of the noise signal 114 is deemed to have deviated from the expected noise floor, the noise-cancellation system 100 can suspend operation in order to avoid adding noise to the vehicle cabin as a result of a malfunctioning reference sensor 106. In another example, if only one reference sensor 106, or a subset of reference sensors 106, of a plurality of reference sensors 106 is deemed to have deviated from the expected noise floor, then the noise-cancelation signal 118 can be calculated excluding the malfunctioning reference sensors. For example, the coefficients of $W_{adapt}$ filter 126 can be updated excluding the noise signals 114 received from malfunctioning reference sensors 106. Finally, in either case, a user or technician can be notified of the malfunctioning reference sensor 106 so that the reference sensor 106 can be serviced or replaced.

Again, the noise-cancellation system 100 of FIGS. 1 and 2 is merely provided as an example of such a system. This system, variants of this system, and other suitable noise-cancellation systems can be used within the scope of this disclosure.

FIGS. 3A-3K depict a flowchart of the computer-implemented method for estimating the noise floor of a sensor and for detecting when the estimated noise floor deviates from an expected noise floor. As described above, this method may be implemented by a computing device such as controller 112, a general-purpose computer, or other some suitable computing device. Generally, the steps of the computer-implemented method are stored in a non-transitory storage medium disposed in communication with a processor of the computing device and are executed by the processor of the computing device. For the purposes of this disclosure, a noise floor of a sensor is defined as the noise present in the sensor output signal when the sensor is not receiving any input.

Figure 3A:
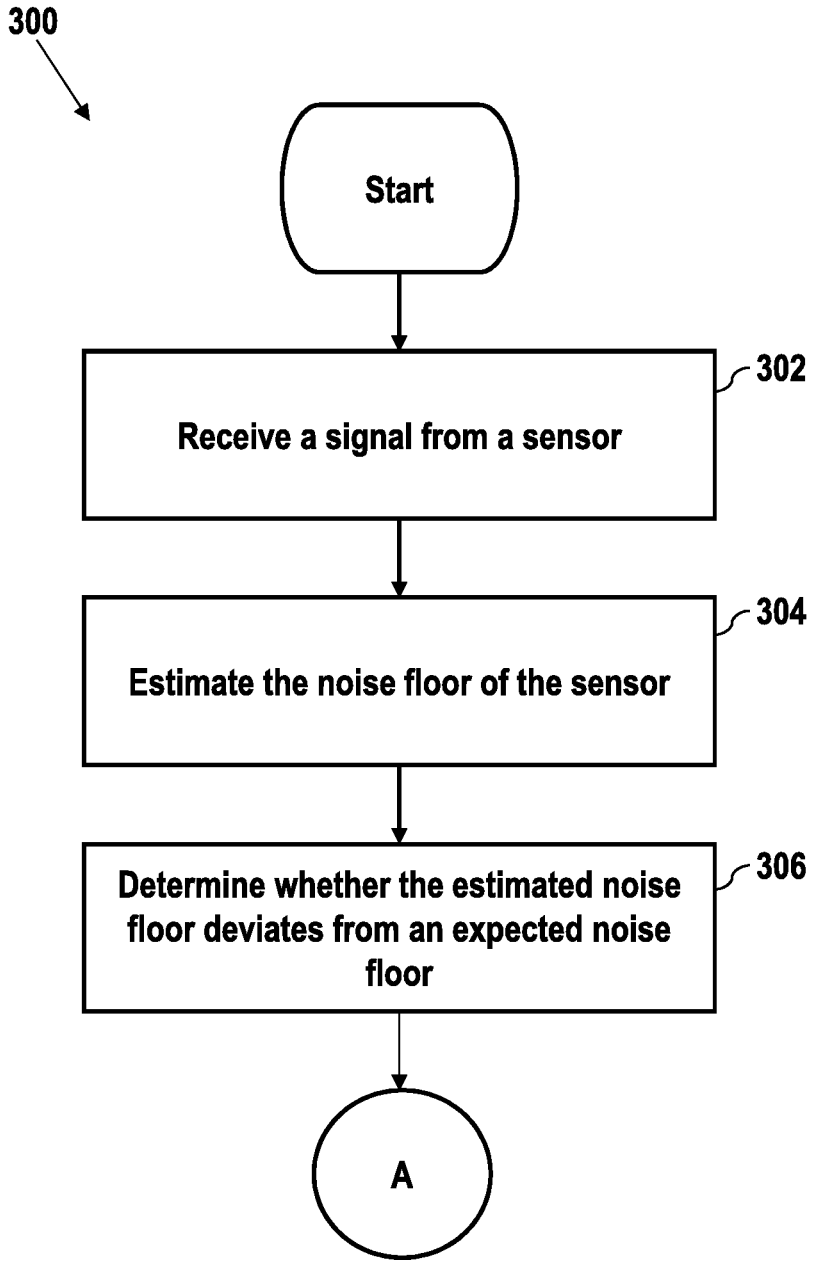
FIG. 3A depicts a flowchart of a method for estimating the noise floor of a sensor and for determining whether the estimated noise floor of the sensor deviates from an expected value, according to an example.

FIG. 3A shows a high-level flowchart of the computer-implemented method, which broadly comprises the steps of identifying a noise floor of a sensor and determining whether the noise floor deviates from an expected noise floor. At a first step 302, a sensor (e.g., accelerometer) signal is received at the computing device. The received signal is digitized (e.g., by an AC-DC converter) into a plurality of samples. The computing device can digitize sensor signal itself or can receive the sample already having been digitized by some upstream processor/device. At step 304, a noise floor of the sensor signal is estimated from the received sensor signal. As will be described in connection with FIGS. 3B-3E, this step can include the steps of selecting a minimum power of at least one power spectral density calculated from the sensor signal. At step 306, the estimated noise floor is compared to an expected noise floor to determine whether the estimated noise floor deviates from an expected noise floor. This step can include the steps of comparing the estimated noise to a threshold and updating a counter accordingly, as will be described in connection with FIGS. 3F-3H. If the estimated noise floor is deemed to have deviated from the expected noise floor, an action can be taken, which, as described in connection with FIGS. 3I-3J, can include the steps of freezing an adaptive process or continuing an adaptive process excluding the malfunctioning sensor. Finally, as will be described in connection with FIG. 3K, computer-implemented method 300 may include the step of monitoring for an update condition, which, if not met, freezes updating the noise floor estimation until the update condition is satisfied.

Figure 3B:
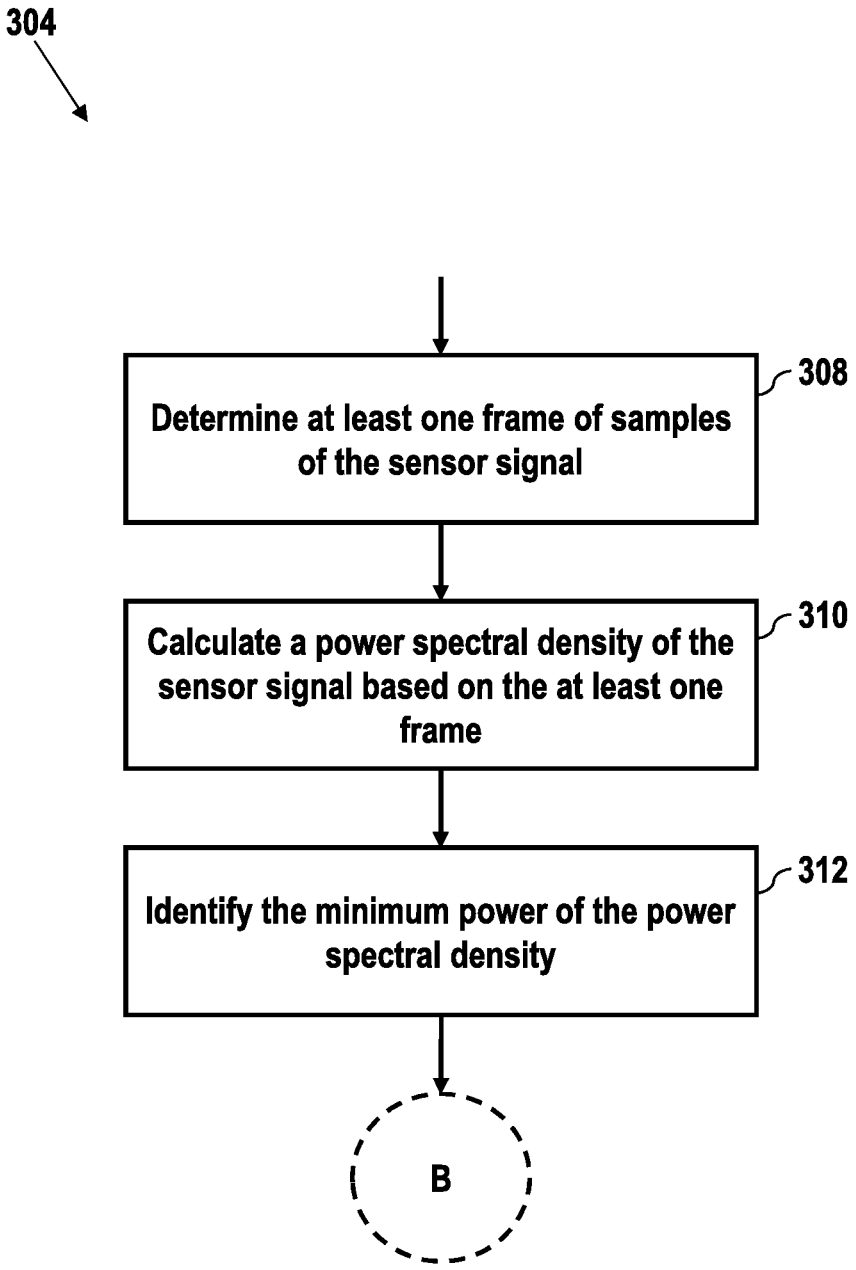
FIG. 3B depicts a flowchart of a method for estimating the noise floor of a sensor, according to an example.

FIG. 3B shows a flowchart of an example implementation of estimating a noise floor of the sensor (step 304 of the described in connection with FIG. 3A). As shown, at step 308 the samples of the sensor signal are organized into at least one frame of samples. Each frame typically includes a plurality of samples, although it is conceivable that each frame could include only a single sample.

At step 310, a power spectral density of the sensor signal is calculated based on the at least one frame of samples determined in step 308. Calculating the PSD of the sensor signal will yield a plurality of frequency bins each associated with a respective power of the sensor signal at the frequency of the frequency bin. The PSD can be calculated according to any method suitable for calculating a PSD. In the simplest example, the PSD can be calculated from a single frame of samples according to the following equation:

$$S_{x_i x_i}(n_F,f)=|X_i(n_F,f)|^2 \tag{2}$$

where $S_{x_i x_i}(n_F,f)$ is the PSD estimate at frequency bin f and at the current frame $n_F$, and $X_i(n_F,f)$ is the value of the ith sensor signal $x_i$ at the frequency bin f and at the current frame $n_F$. (This equation assumes that there are i sensor signals received from i sensors, and thus calculates the PSD of only one of the sensor signals. For the purposes of this disclosure, the ith sensor will alternately be referred to as the sensor-under-test. It is not necessary that the sensor being tested is one of many sensors to be tested.)

Instead of using a single frame, the PSD can also be calculated from multiple frames of samples. In step 308, the samples can be organized into a plurality of successive frames as samples are derived from the sensor signal over time, each frame of the plurality of successive frames differing from the previous frame by at least one sample. Thus, for example, if the first frame includes samples $s_1$, $s_2$, $s_3$, $s_4$, and $s_5$, the next frame can include samples $s_2$, $s_3$, $s_4$, and $s_5$, but also $s_6$. Successive frames can thus overlap in samples but differ by at least one sample. However, successive frames need not overlap at all—indeed, successive frames can be separated by one or more samples. Finally, while each frame typically includes more than one sample, in alternative examples each frame can include only a single sample.

Step 310 will typically be repeated for each new frame of samples determined in step 308. As the samples are derived and organized into successive frames of samples, the power spectral density of the sensor signal can be updated for each new frame using the following equation:

$$S_{x_i x_i}(n_F,f)=(1-\alpha)\cdot|X_i(n_F,f)|^2+\alpha\cdot S_{x_i x_i}(n_F-1,f) \tag{3}$$

where $S_{x_i x_i}(n_F,f)$ is the PSD estimate at frequency bin f and at the current frame $n_F$, $S_{x_i x_i}(n_F-1,f)$ is the previously-computed PSD estimate at the same frequency bin, a is a smoothing constant, and $X_i(n_F,f)$ is the value of the ith sensor signal $x_i$ at the frequency bin f and at the current frame $n_F$. The initial values of the PSDs, that is $S_{x_i x_i}(0,f)$, can be set to any suitable predetermined sensor noise floor value.

The above Eq. (3) represents a memory-efficient method of calculating a PSD of the current frame, using the previous-calculated PSD to update the current PSD. In alternative examples, the previous frames can be stored in memory and used to calculate the PSD each time the PSD is calculated. (As will be described below, a new frame is typically generated, and the PSD updated, each time step 304 is repeated as part of a loop. However, it is conceivable that multiple frames can be generated, and the PSD updated or otherwise calculated as part of a single execution of step 304.)

At step 312, the noise floor of the ith sensor signal can be estimated from the PSD of the sensor, calculated in step 310, by selecting the minimum power of the calculated PSD, as follows:

$$NF_i(n_F)=\min S_{x_i x_i}(n_F,f), f=f_{min} \ldots f_{max} \tag{4}$$

where $S_{x_i x_i}(n_F,f)$ is the PSD calculated, e.g., according to Eqs. (2) or (3) described above and $f_{min} \ldots f_{max}$ is a range of frequencies from which the minimum power is selected. The range of frequencies can be a range of frequencies for which the sensor is known to reduce to the measured noise floor. For example, in the context of an accelerometer disposed in a vehicle, the subset of frequencies can be the frequencies for which the accelerometer reduces to the noise while the vehicle is at idle. The range of frequencies can be coextensive with the range of frequencies for which the PSD is found or can be a subset of those frequencies. The result of step 312 is an estimated noise floor of the ith sensor. This estimated noise floor can then be compared to a threshold or used to update a counter in order to determine whether the noise floor deviates from an expected noise. These steps will be described in more detail below.

The noise floor as estimated in step 310, is, however, not necessarily reliable since it is not known, at the time of calculation, whether the estimated noise floor is in fact representative of the noise floor of the sensor or the result of some input to the sensor. For example, if the sensor is an accelerometer disposed in an idling vehicle, music playing in the vehicle can cause the accelerometer to output a signal that corresponds to the vibrations resulting from the music and is thus not representative of the noise floor of the accelerometer itself. In other words, even the minimum power of the PSD can contain some amount of input signal and thus not be representative of the noise floor of the sensor. One or multiple steps can be taken to mitigate the risk of an inaccurate noise floor estimate.

Figure 3C:
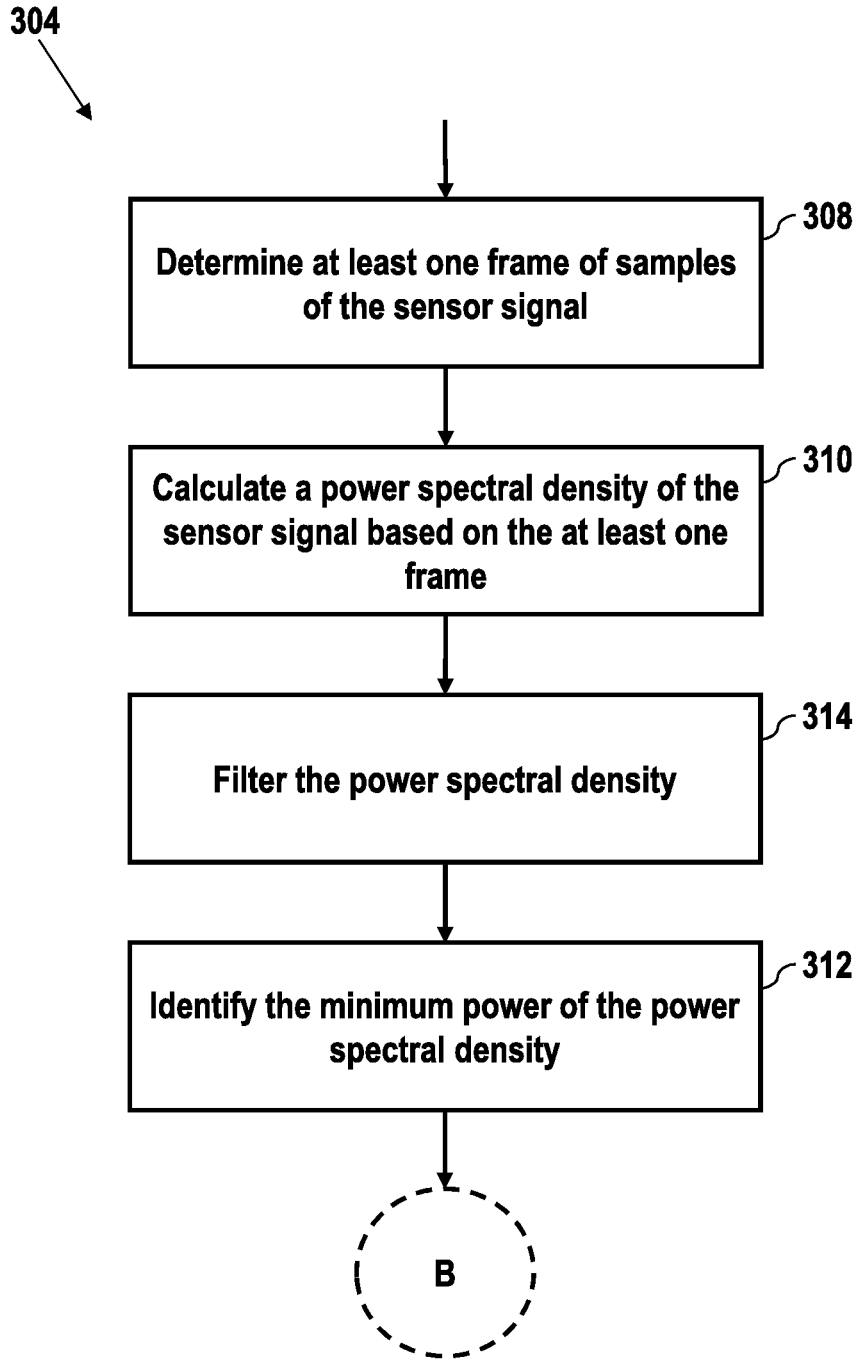
FIG. 3C depicts a flowchart of a method for estimating the noise floor of a sensor, according to an example.

FIG. 3C is the same as FIG. 3B with the inclusion of step 314. Step 314 adds an additional step of filtering the result of the PSD calculation before selecting the minimum power in order to estimate the noise floor. The filtering of the PSD can be accomplished by any suitable method of digital filtering that reduces transient peaks in the frequency domain. By definition, such peaks are not representative of the noise floor of the sensor but are rather the result of some input (e.g., vibrations) to the sensor. For example, PSD calculation can be smoothed in the frequency domain according to median filtering, where the value at each frequency bin is replaced by the median of the values in adjacent bins as follows:

$$\tilde{S}_{x_i x_i}(n_F,f)=\text{median}\{S_{x_i x_i}(n_F,f-f_L), \ldots, S_{x_i x_i}(n_F,f), \ldots, S_{x_i x_i}(n_F,f-f_R)\} \tag{5}$$

where $f_L$ and $f_R$ are determined by the median filter order. In an alternative example, the values of the PSD can be averaged, either across the length of the PSD or locally around each frequency bin. This method, is, however, less desirable than median filtering since averaging tends to raise the overall value of the calculated power values of the PSD above an accurate estimate of the noise floor.

In addition, rather than calculating a single PSD or using only the most-currently calculated PSD to estimate the noise floor, the noise floor may be selected from a historical set of PSD calculations. Two methods for selecting a noise floor from a set of a historical PSD calculations are shown in FIGS. 3D and 3E.

Figure 3D:
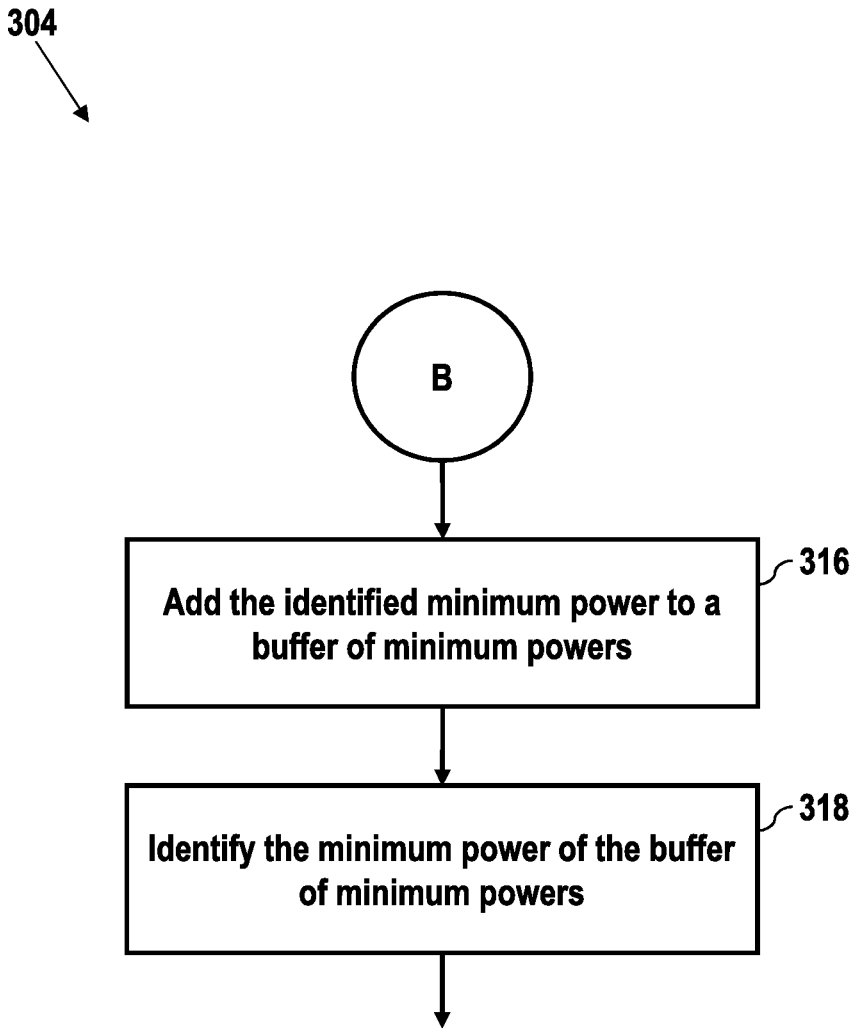
FIG. 3D depicts a flowchart of a method for estimating the noise floor of a sensor, according to an example.
Figure 3E:
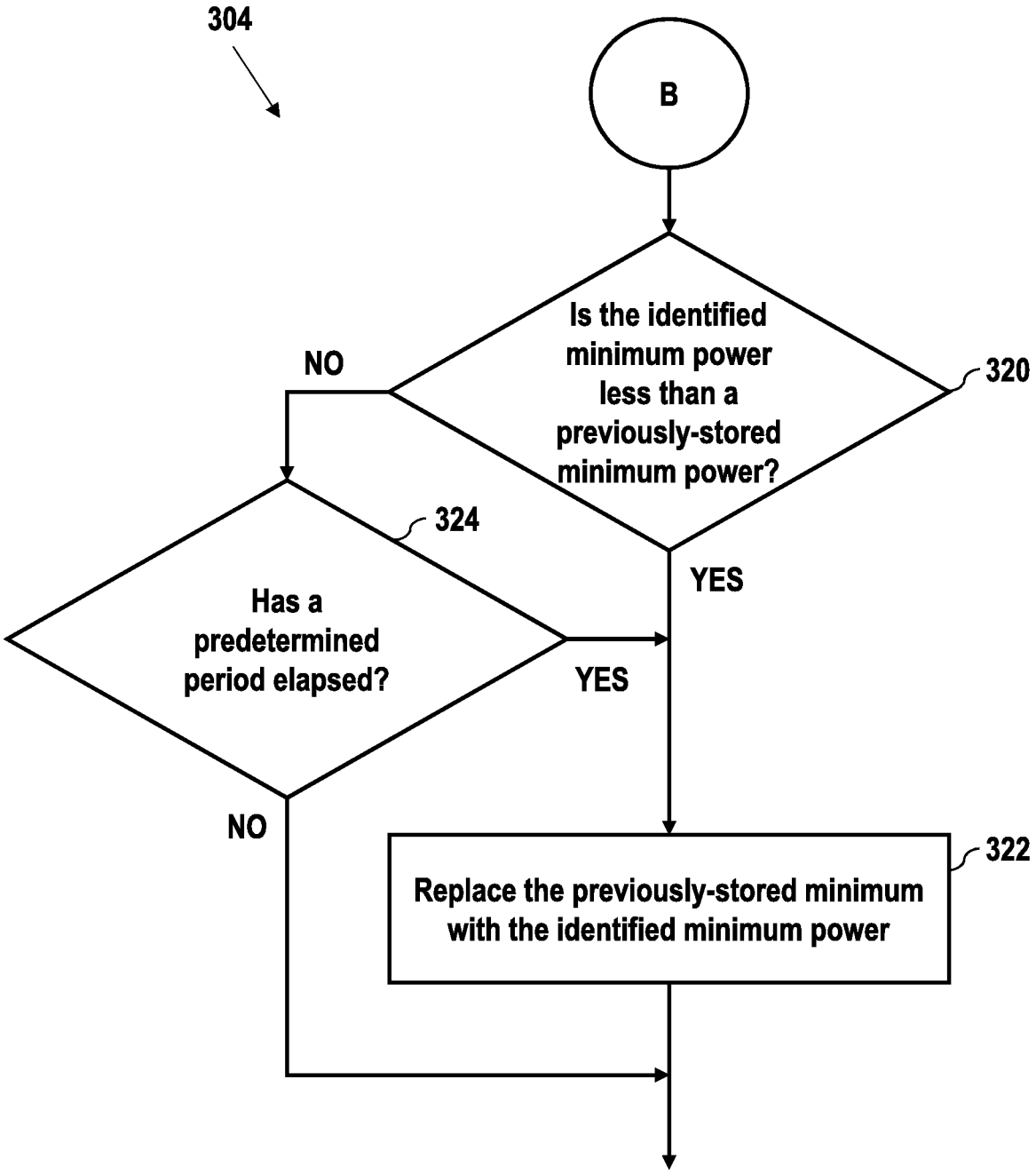
FIG. 3E depicts a flowchart of a method for estimating the noise floor of a sensor, according to an example.

Turning first to FIG. 3D, at 316 the minimum power identified in step 312 is stored in a buffer of minimum power values. Each of the minimum power values thus stored in the buffer originates from a PSD taken with respect to a certain frame of samples (and the historical frames preceding, as described in connection with step 310). As a result, the buffer of minimum power values represents a historical set of minimum values taken over time.

Stated differently, as described in connection with step 310 and Eq. (3) the PSD calculation can be updated over time as successive frames are defined according to newly received samples of the sensor signal. Thus, each PSD update, based on a respective successive frame, can be used to generate a new noise floor estimate, which can be stored in a buffer as a history of noise floor estimates.

At step 316, from this buffer, the minimum noise floor can be selected as being the noise floor estimate as follows:

$$\widehat{NF}_i = 10\cdot\log_{10}[\min NF_i(n_F-j)]+NF_{offset} j=0 \ldots N_h-1 \quad (7)$$

where j is the time index of the buffer and $NF_{offset}$ is the offset that is used to compensate for the normalization factors of the PSD. Several factors determine the needed offset, including the time-domain window size, the number of FFT points, the window that is used (rectangular, Hamming, Hanning, etc.) and the sampling frequency. These normalization factors are understood in the art and can be implemented at any suitable time, not just during step 316.

The net result of steps 316 and 318 is the implementation of a window of time from which a noise floor is estimated by storing the last $N_h$ estimates for the sensor-under-test. The length of the window of time is determined by the length of buffer, which, in an example, is a circular buffer, although any first-in-first-out buffer can be used. The length of this window can be tuned by setting a maximum number of frames $N_h$ and varying the number of frames that are used in the floor estimation. Once a number is found that yields reliable results, the maximum number of frames $N_h$ is changed to the suitable number.

In an alternative example, rather than storing a minimum power of each historical power spectral density, a plurality of power spectral densities may be stored and the minimum power selected from across the plurality of power of spectral densities. This is, however, less memory efficient since it requires the storage of additional data (the entire PSD) in memory rather than only the minimum power of each PSD. Storing multiple PSDs, however, permits the estimation of a noise floor per frequency bin rather than a single noise floor across all the stored PSDs. In other words, instead of selecting a minimum power across all PSDs, a minimum power per frequency bin across all PSDS can be selected, yielding a set of minimum powers across frequency. This can be useful for detecting whether the noise floor is deviating for one frequency. Alternatively, instead of storing the minimum for each frequency bin, the minimum can be stored for a subset of frequency bins of the PSD.

Turning now to FIG. 3E, the noise floor history may be implemented by storing a single noise minimum frame. In this example, each time the PSD is updated, the stored noise floor estimation is only replaced if the new noise floor estimation is less than the previously-stored estimate. Over a period of time, this will yield the minimum noise floor estimate from a set of calculated noise floor estimates. Step 320 is thus a decision block that asks whether identified minimum power (from step 312) is less than a previously-stored minimum power. The previously-stored minimum power is from an earlier-calculated power spectral density. If the identified minimum power is less than the previously-stored minimum power, then the identified minimum power replaces the previously-stored minimum power in step 322. (If there is no previous minimum power, then the identified minimum power is stored.) In this manner, only the minimum identified minimum power is stored rather than a buffer of minimum powers being stored at once, as described in connection with FIG. 3D.

This method would, however, have the effect of failing to update the currently-stored noise floor estimate if the noise floor consistently rose over time (as the new noise floor estimate would never be lower than the previously-calculated noise floor estimate). Thus, step 324 requires a periodic mandatory update of the noise floor estimate. Step 324 is, therefore, a decision block that asks whether a predetermined period of time has elapsed at step 322. If the period of time has elapsed, then previously-stored minimum power is replaced with the newly-identified minimum power. The period of time of step 324 is comparable to the length of the buffer of FIG. 3D since it defines the window of time from which the noise floor estimate is calculated. The period of time can thus be similarly tuned by varying the length of the period of time from a maximum until a good value is found. (The order of steps 320 and 324 can be changed without affecting the functioning of the method described in connection with FIG. 3E.)

In an alternative example, a noise floor can be estimated per frequency bin. This can be accomplished by comparing, for each frequency bin, a previously-stored power against a new power. If the new power is less than the previously-stored power, then the new power replaces the previously-stored power as a minimum power for the given frequency bin, thus storing a set of minimum powers across frequency. Furthermore, the power for each frequency bin can be updated after a mandatory period. Alternatively, rather than storing a power for each frequency bin, a power may be stored for a subset of frequency bins.

Figure 3F:
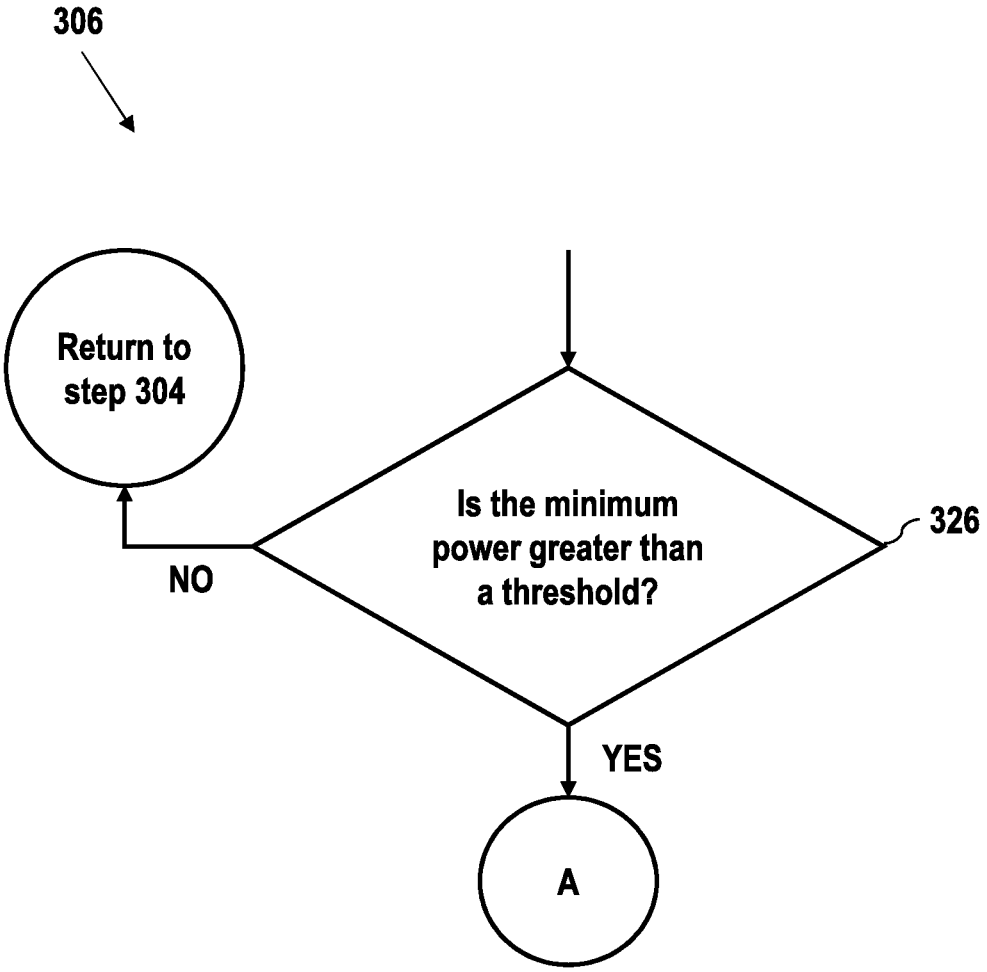
FIG. 3F depicts a flowchart of a method for determining whether the estimated noise floor of the sensor deviates from an expected value, according to an example.

The methods described in connection with FIGS. 3D and 3E thus both describe ways to generate an estimated noise floor by identifying a minimum power from a plurality of historical power spectral densities, each power spectral density being determined from a respective frame of a successive set of frames (e.g., in accordance with Eq. 3). In this way, no single PSD is relied upon too heavily, and a PSD affected by a sensor input likely will be disregarded rather than used as the basis for a noise floor estimation. Once the noise floor of the sensor is estimated, the noise floor is examined to determine whether it deviates from an expected value (step 306). In the simplest example, to determine whether the noise floor deviates from an expected amount, the estimated noise floor calculated in step 304 is compared to a threshold. If the estimated noise floor exceeds the threshold, the sensor can be deemed to have deviated from the expected noise floor. This method is shown in FIG. 3F as a condition block that asks whether the minimum power identified in step 304 is greater than a threshold. If the minimum power is greater than the threshold, then the noise floor is deemed to have deviated from the expected nose floor and the flowchart proceeds to one of a number of possible mitigating actions (represented by the A connector and described in more detail in connection with FIGS. 3I and 3J).

If the noise floor does not exceed the threshold then the method returns to step 304 to identify a new noise floor estimate based, at least in part, on a frame of newly-received samples. Thus, method 300 represents a loop that determines a noise floor estimate, determines whether the estimate deviates from the expected noise, and repeats. The repeating nature of method 300 (and specifically of steps 302-306) is assumed in steps 316-322 which require the selection of a noise floor estimate from a historical set of power spectral densities (e.g., the plurality of minimum powers stored in the buffer of step 316 or the previously-stored minimum power), each historical power spectral density having thus been rendered in a previous iteration of step 304.

The threshold of step 326 can be a predetermined threshold or can be determined during runtime based on historical values or other factors. For example, the threshold can be based on an average of estimated noise floors taken over a predetermined period of time.

Using a threshold as the sole determiner of deviation, however, is prone to false positives (i.e., in the event that an input signal, incorrectly designated as a noise floor, exceeds the threshold). Setting a relatively high threshold can help avoid such false positives but can result in unnecessary delays in detecting the deviation in the noise floor since the estimated noise floor has to rise to a higher level than strictly necessary.

Figure 3G:
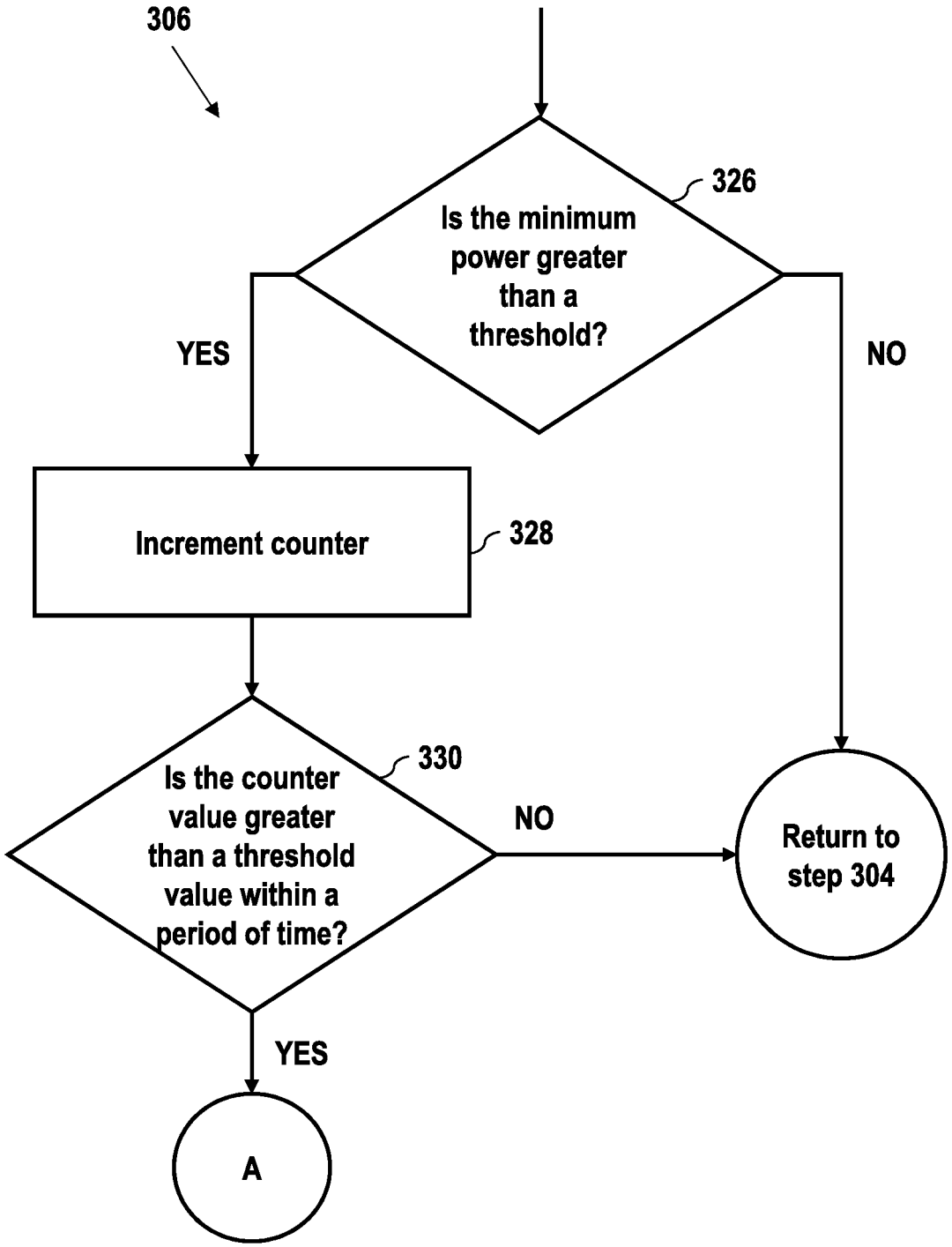
FIG. 3G depicts a flowchart of a method for determining whether the estimated noise floor of the sensor deviates from an expected value, according to an example.

Thus, in an alternative example, if the minimum power exceeds the threshold of step 326, a counter is incremented. If the counter exceeds a predetermined amount within a certain period of time, the sensor is deemed to have deviated from the expected noise floor. The period of time is thus a sliding window of time during which a certain number of noise floor estimates must exceed the threshold of step 326 in order to determine that the sensor has deviated from the expected noise floor. An example of this is represented in FIG. 3G, which requires that a counter be incremented at step 328 if the minimum power is greater than the threshold of step 326. At step 330, a decision block asks whether the counter value is greater than a threshold value within a period of time. In an example, the counter can be realized by a circular buffer that stores whether each successive minimum power (resulting from the repeated execution of step 304) rendered over a period of time exceeds the threshold (e.g., the buffer can store a 1 if a given minimum power exceeds the threshold and a 0 if the minimum power fails to exceed the threshold). Thus, in step 330, if the buffer stores, at any one time, more than a predetermined threshold number of instances in which the buffer exceeded the threshold (e.g., more than certain number of 1's) then the sensor is deemed to have deviated from the noise floor. This is merely provided as an example implementation of the counter of the method described in connection with FIG. 3G and should not be deemed limiting.

Similar to the example method of FIG. 3F, if the sensor is deemed to have deviated from the noise floor, a mitigative action can be taken (connector A); whereas, if the sensor is not deemed to have deviated from the noise floor, the method returns to step 304 to generate a new noise floor estimate.

Figure 3H:
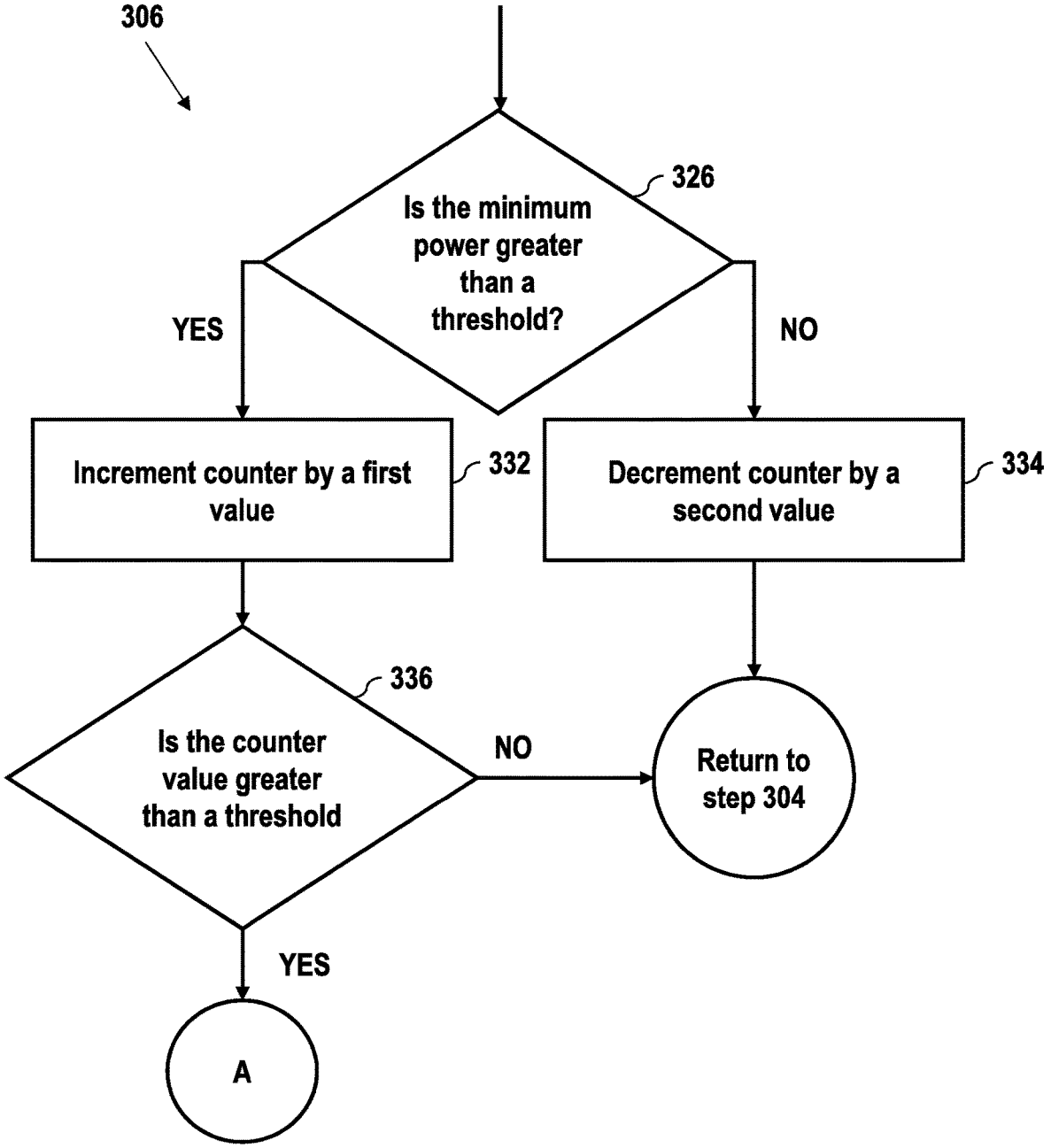
FIG. 3H depicts a flowchart of a method for determining whether the estimated noise floor of the sensor deviates from an expected value, according to an example.

The method described in connection with FIG. 3G, however, may fail to sufficiently weight instances in which the noise floor failed to exceed the threshold, which are unlikely to occur in a sensor with a rising noise floor. Thus, in yet another example, each time the estimated noise floor exceeds the predetermined threshold a counter can be incremented. Each time the estimated noise floor fails to exceed the predetermined threshold, the counter can be decremented. Once the counter value exceeds a predetermined value, the sensor can be deemed to have deviated from the expected noise floor. The value of the incrementation and decrementation can be different or the same. This method is shown in FIG. 3H, in which the result of the step 326 decision block increments the counter by a first value (step 332) or decrements the counter by a second value (step 334). At step 336, if the counter value is greater than threshold value an action is taken (proceeds to connector A). If, however, the counter value is less than the threshold value, the method returns to step 304 to generate a new noise floor estimate.

Figure 3I:
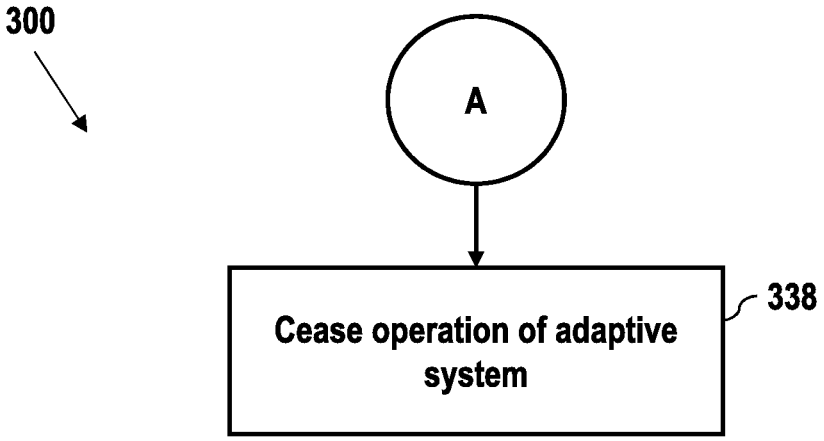
FIG. 3I depicts a flowchart of a method for estimating the noise floor of a sensor, for determining whether the estimated noise floor of the sensor deviates from an expected value, and for taking mitigating action, according to an example.

Once the sensor is deemed to have deviated from the expected noise floor, one of several actions can be taken. If sensor is used in an adaptive system, such as in a noise-cancellation system, the operation of the adaptive system can be halted. This is shown in FIG. 3I, step 338. Ceasing operation of the adaptive system can avoid a situation in which the noisy sensor causes the adaptive system to malfunction. For example, as mentioned above, a noisy sensor in a noise-cancellation system can cause the system to add noise, rather than cancel it. Once the operation of the adaptive system is halted, it can remain off until the sensor is serviced or replaced. To that end, the sensor can be identified to the user for future servicing or replacement.

Figure 3J:
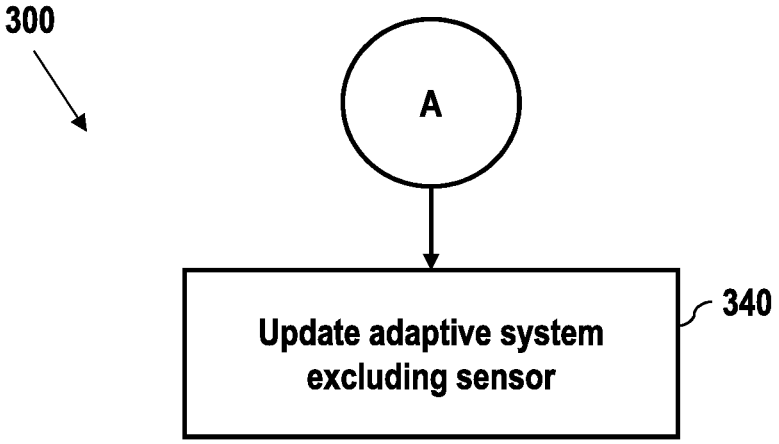
FIG. 3J depicts a flowchart of a method for estimating the noise floor of a sensor, for determining whether the estimated noise floor of the sensor deviates from an expected value, and for taking mitigating action, according to an example.

In an alternative example, if the sensor is one of several sensors used in an adaptive system, the sensor deemed to have exceeded the expected noise floor can be excluded from future updates of the adaptive system. Thus, in a vehicle-implemented noise-cancellation system, if an accelerometer-under-test is deemed to have a high noise floor, the noise-cancellation system can be updated using the remaining accelerometers and thus excluding the accelerometer-under-test. Furthermore, because each filter associated with the faulty sensor is nonzero, it will continue to produce a signal to be played by the speaker. Accordingly, any filters associated with the faulty sensor are prevented from producing a signal to the speaker. Stated differently, when a sensor is found to be faulty, its contribution to the update equation as well as to the speaker signals (N outputs, one per speaker) is removed, thus removing the faulty sensor from the production of the noise-cancellation signal. This is shown in FIG. 3J, step 340. Like the example of FIG. 3I, a user can be notified of the malfunctioning sensor so that the sensor can be serviced or replaced.

If multiple noise floors are found for multiple frequency bins, the steps described in connection with FIGS. 3F-3H can be repeated for each estimated noise floor. If the noise floor of any given frequency bin is found to have deviated from the expected noise floor, then one of the mitigative actions described in connection with FIGS. 3I-3J can be taken.

In the vehicle-implemented noise-cancellation system embodiment, the operation of the vehicle can interfere with the estimation of the noise floor. It is thus useful to require that the vehicle be in an idle state (thus minimizing interfering vibrations from the engines) before the noise floor is estimated.

Figure 3K:
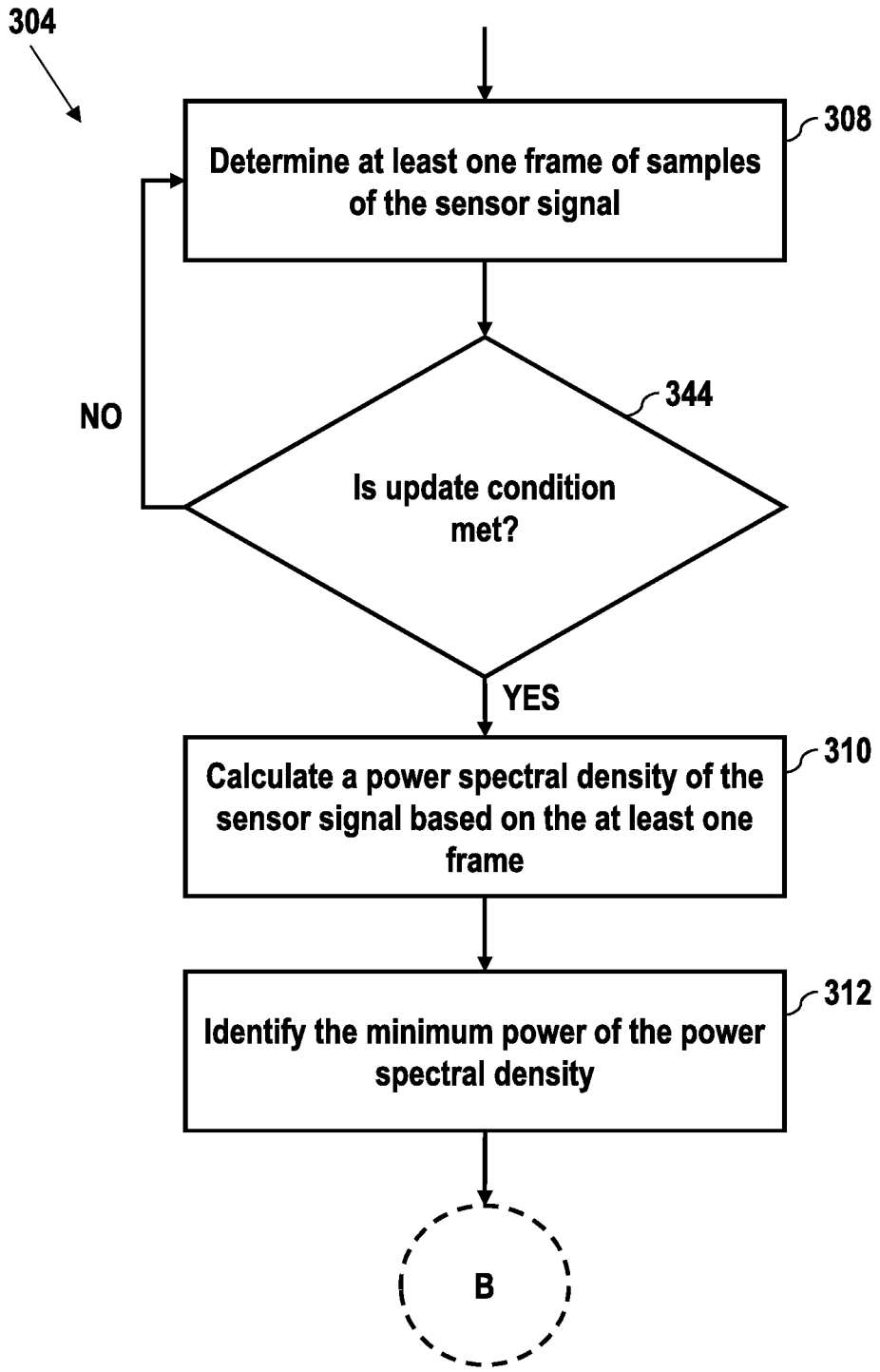
FIG. 3K depicts a flowchart of a method for checking an update condition and for estimating the noise floor of a sensor, according to an example.

Accordingly, in the example of step 304 shown in FIG. 3K, an update condition is checked before the noise estimation is calculated. This is represented in step 344 as a decision block that asks whether an update condition is met. If the update condition (e.g., the vehicle is at idle) the noise estimation proceeds to step 310. If, however, the update condition is not met, then method returns to step 308 and awaits the next frame. Step 344 is thus a loop that checks whether the update condition is met each time a new frame is generated from the new samples received from the sensor. Until the update condition is met, step 304 will not generate a new noise estimate. The result is that frames that were taken while the update condition was not met are thus disregarded.

The conditions for the update that can be checked include, for example, the vehicle speed (to determine if the vehicle is moving), the accelerator pedal position (to determine if accelerator is pressed, even if the vehicle is not moving), the engine RPM (to determine if the accelerator has been pressed and released before the RPMs have reached idle). Each of these conditions can be read from, for example, the vehicle CAN bus, which relays the state of these conditions to the controller. In addition to, or instead of, reading the inputs from the vehicle CAN bus, the harmonics of the engine may be analyzed via the accelerometer input to determine whether they are characteristic of a vehicle at idle. The above-described checks are simply an example of the kind of checks that can be conducted to determine if the engine is in an idle state and other checks that would similarly ascertain the state of the vehicle are within the scope of this disclosure. Furthermore, in addition to checking whether the engine is in an idle state, other conditions that can negatively influence the noise floor estimation, such as the opening or closing of a vehicle door or the playing of music can also be checked during the update condition.

The above-described system and method for detecting when the noise floor of a sensor deviates from an expected noise floor improves the functioning of a computer by allowing a computer to reliably estimate the noise floor of a sensor and to determine when the noise floor has deviated from an expected value. Furthermore, the above-described system improves the functioning of a computer by permitting a computer to take corrective action once a malfunctioning sensor is identified.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A computer-implemented method for detecting a noise floor of a sensor, comprising the steps of:

receiving a sensor signal from a sensor;

determining a plurality of power spectral densities from a plurality of successive frames of samples of the sensor signal, each of the plurality of power spectral densities being determined from a respective frame of the plurality of successive frames, each power spectral density being comprised of a plurality of frequency bins, each frequency bin being associated with a power of the sensor signal at the frequency of the respective frequency bin, wherein each successive frame of the plurality of successive frames differs by at least one sample;

identifying a minimum power of the plurality of power spectral densities;

determining, according to at least one condition, whether a vehicle in which the sensor is disposed is in an idle state; and determining, upon determining the vehicle is disposed in an idle state, whether the minimum power exceeds a threshold value.

2. The computer-implemented method of claim 1, wherein the at least one condition is selected from at least one of: vehicle engine revolutions per minute, accelerator pedal position, vehicle speed, and engine harmonics.

3. The computer-implemented method of claim 1, wherein the at least one condition further comprises detecting whether a door of the vehicle opened or closed.

4. The computer-implemented method of claim 1, further comprising the step of filtering each power spectral density of the plurality of power spectral densities such that frequency spikes within each power spectral density are reduced.

5. The computer implemented method of claim 4, wherein each power spectral density is filtered using median filtering.

6. The computer-implemented method of claim 1, further comprising the step of incrementing a counter by a first value if the minimum power exceeds the threshold value and decrementing a counter by a second value if the minimum power fails to exceed the threshold value.

7. The computer-implemented method of claim 6, further comprising the step of excluding the sensor signal from an adaptive filter update calculation if a value of the counter exceeds a counter value.

8. The computer-implemented method of claim 6, wherein the first value and the second value are the same.

9. The computer-implemented method of claim 1, further comprising the steps of:

incrementing a counter by a predetermined amount if the minimum power exceeds the threshold value;

excluding the sensor signal from an adaptive filter update calculation if a value of the counter exceeds a counter value; and excluding a filter associated with the sensor signal from the production of a noise-cancellation signal.

10. A non-transitory storage medium comprising program code that, when implemented by a processor, causes the processor to execute the steps comprising:

receiving a sensor signal from a sensor;

determining a plurality of power spectral densities from a plurality of successive frames of samples of the sensor signal, each of the plurality of power spectral densities being determined from a respective frame of the plurality of successive frames, each power spectral density being comprised of a plurality of frequency bins, each frequency bin being associated with a power of the sensor signal at the frequency of the respective frequency bin, wherein each successive frame of the plurality of successive frames differs by at least one sample;

identifying a minimum power of the plurality of power spectral densities;

determining, according to at least one condition, whether a vehicle in which the sensor is disposed is in an idle state; and determining, upon determining the vehicle is disposed in an idle state, whether the minimum power exceeds a threshold value.

11. The non-transitory storage medium of claim 10, wherein the at least one condition is selected from at least one of: vehicle engine revolutions per minute, accelerator pedal position, vehicle speed, and engine harmonics.

12. The non-transitory storage medium of claim 10, wherein the at least one condition further comprises detecting whether a door of the vehicle opened or closed.

13. A non-transitory storage medium of claim 10, further comprising the step of filtering each power spectral density of the plurality of power spectral densities such that frequency spikes within each power spectral density are reduced.

14. The non-transitory storage medium of claim 13, wherein each power spectral density is filtered using median filtering.

15. The non-transitory storage medium of claim 10, further comprising the step of incrementing a counter by a first value if the minimum power exceeds the threshold value and decrementing a counter by a second value if the minimum power fails to exceed the threshold value.

16. The non-transitory storage medium of claim 15, further comprising the step of excluding the sensor signal from an adaptive filter update calculation if a value of the counter exceeds a counter value.

17. The non-transitory storage medium of claim 15, wherein the first value and the second value are the same.

18. The non-transitory storage medium of claim 10, further comprising the steps of:

incrementing a counter by a predetermined amount if the minimum power exceeds the threshold value;

excluding the sensor signal from an adaptive filter update calculation if a value of the counter exceeds a counter value; and excluding a filter associated with the sensor signal from the production of a noise-cancellation signal.

19. A non-transitory storage medium comprising program code that, when implemented by a processor, causes the processor to execute the steps comprising:

receiving a sensor signal from a sensor;

determining a plurality of power spectral densities from a plurality of successive frames of samples of the sensor signal, each of the plurality of power spectral densities being determined from a respective frame of the plurality of successive frames, each power spectral density being comprised of a plurality of frequency bins, each frequency bin being associated with a power of the sensor signal at the frequency of the respective frequency bin, wherein each successive frame of the plurality of successive frames differs by at least one sample;

identifying a minimum power of the plurality of power spectral densities;

determining whether the minimum power exceeds a threshold value; and excluding the sensor signal from an adaptive filter update calculation, based, at least, upon determining that the minimum power exceeds the threshold value.

20. The non-transitory storage medium of claim 19, further comprising the step of determining, according to at least one condition, whether a vehicle in which the sensor is disposed is in an idle state, wherein the step of determining whether the minimum power of the sensor signal exceeds the threshold value only occurs when the vehicle is in the idle state.

21. The non-transitory storage medium of claim 20, wherein the at least one condition is selected from at least one of: vehicle engine revolutions per minute, accelerator pedal position, vehicle speed, and engine harmonics.

22. The non-transitory storage medium of claim 20, wherein the at least one condition further comprises detecting whether a door of the vehicle opened or closed.

23. A non-transitory storage medium of claim 19, further comprising the step of filtering each power spectral density of the plurality of power spectral densities such that frequency spikes within each power spectral density are reduced.

24. The non-transitory storage medium of claim 23, wherein each power spectral density is filtered using median filtering.

25. The non-transitory storage medium of claim 19, further comprising the step of incrementing a counter by a first value if the minimum power exceeds the threshold value and decrementing a counter by a second value if the minimum power fails to exceed the threshold value.

26. The non-transitory storage medium of claim 25, wherein the first value and the second value are the same.

27. The non-transitory storage medium of claim 19, further comprising the steps of:

incrementing a counter by a predetermined amount if the minimum power exceeds the threshold value;

excluding the sensor signal from an adaptive filter update calculation if a value of the counter exceeds a counter value; and excluding a filter associated with the sensor signal from the production of a noise-cancellation signal.

* * * * *